US006456009B1

(12) United States Patent
Wright et al.

(10) Patent No.: US 6,456,009 B1
(45) Date of Patent: Sep. 24, 2002

(54) ADAPTIVE HEATER VOLTAGE ALGORITHM AND CONTROL SYSTEM FOR SETTING AND MAINTENANCE OF THE HEATER VOLTAGE OF A VACUUM ELECTRON DEVICE

(75) Inventors: Edward L. Wright, Union City; Eric Oiesen, Ben Lomand, both of CA (US)

(73) Assignee: Communication and Power Industries, San Carlos, CA (US)

( * ) Notice: Subject to any disclaimer, the term of this patent is extended or adjusted under 35 U.S.C. 154(b) by 0 days.

(21) Appl. No.: 09/629,315

(22) Filed: Jul. 31, 2000

(51) Int. Cl.[7] ..... H01J 23/04
(52) U.S. Cl. ..... 315/5; 315/5.39; 315/107
(58) Field of Search ..... 315/5, 5.35, 5.39, 315/107, 117

(56) References Cited

U.S. PATENT DOCUMENTS

| | | | | |
|---|---|---|---|---|
| 4,072,865 A | | 2/1978 | Craig et al. | 250/409 |
| 4,247,801 A | | 1/1981 | Dallos et al. | 315/107 |
| 4,825,028 A | | 4/1989 | Smith | 219/10.55 |
| 5,130,606 A | | 7/1992 | Morrish et al. | 315/107 |
| 5,550,432 A | * | 8/1996 | Barker | 315/5 |
| 5,571,439 A | | 11/1996 | Daley et al. | 219/716 |
| 5,721,470 A | | 2/1998 | Kuriyama et al. | 315/94 |
| 5,760,544 A | | 6/1998 | Taniguchi et al. | 315/39 |
| 5,798,614 A | | 8/1998 | Bishop | 315/107 |

FOREIGN PATENT DOCUMENTS

| | | |
|---|---|---|
| EP | 0 464 996 A2 | 1/1992 |
| GB | 2019172 A | 10/1979 |
| GB | 2095007 A | 9/1982 |

* cited by examiner

*Primary Examiner*—David Vu
(74) *Attorney, Agent, or Firm*—Thelen Reid & Priest LLP

(57) ABSTRACT

An adaptive heater voltage algorithm and control system for setting and maintaining a vacuum electron device (VED) heater voltage, such as that of a klystron. An algorithm and control system are disclosed that sets and maintains the VED's cathode at the lowest temperature required for 98% of the beam current that corresponds to a fully space charge limited (FSCL) operation. VED lifetime is dependent upon cathode temperature, and in general, a cooler cathode will last longer. The optimum heater voltage corresponds to the beam current that is 98% of the beam current during FSCL operation. As the VED ages and the cathode becomes depleted, the heater voltage will need to be gradually increased to maintain the 98% FSCL value. There are, therefore, two stages to the adaptive heater voltage algorithm—(1) initial determination of the heater voltage and (2) the determination of the heater voltage during amplifier operation.

37 Claims, 3 Drawing Sheets

ADAPTIVE HEATER VOLTAGE ALGORITHM AND CONTROL SYSTEM FOR SETTING AND MAINTENANCE OF THE HEATER VOLTAGE OF A VACUUM ELECTRON DEVICE

BACKGROUND

1. Technical Field

This invention relates to linear beam tubes and more particularly to setting and maintaining the heater voltage of these and other vacuum electron devices (VEDs).

2. Description of Related Art

It is generally known that the higher the heater voltage applied to the cathode of a vacuum electron device, the higher the operating temperature of the cathode. One of the major factors limiting cathode life in a klystron tube, for example, is an excessive cathode operating temperature for a given cathode type. The majority of users of klystron tubes are accustomed to a constant heater voltage as the klystron requirements usually specify fixed values.

An example is the semi-manual adjustment method used at the Stanford Linear Accelerator Center (SLAC) in Stanford, Calif. In the SLAC, one of the linear accelerators includes two hundred forty S-band (2856 MHz) klystrons operating at power levels exceeding 60 MW to provide the RF power to the accelerator. Technicians periodically adjust the heater voltage when lower than the normal klystron output power (cathode current) is observed. The life expectancy reported in this mode of operation at a current level of 6 A/cm$^2$ exceeds 50,000 hours in pulsed mode. At 2 A/cm$^2$ cathode loading, the expected life of a klystron should exceed 100,000 hours.

SUMMARY

This invention relates to a beam current monitoring system for a vacuum electron device including a power supply for generating the heater beam voltage in the vacuum electron device. A beam current monitor monitors the cathode beam current in the vacuum electron device and indicates to the power supply the heater and beam voltage to the vacuum electron device to generate the beam current. The system includes a microprocessor under software program management for controlling the beam voltage indicator in response to the beam current monitor. The software program includes an algorithm for maintaining the cathode of the vacuum electron device at the lowest temperature required for a predetermined percent of the beam current that corresponds to a fully space charge limited operation of said vacuum electron device.

A method is also disclosed for setting the heater voltage in said vacuum electron device to a value corresponding to the beam current for the fully space charge limited (FSCL) operation of the VED. The heater voltage is lowered to a first predetermined percent of FSCL, then the heater voltage is then increased to generate a higher beam current that corresponds to a second, higher, predetermined percent of the beam current that corresponds to a FSCL operation of said VED.

Also disclosed is a computer readable medium including program instructions for setting and maintaining vacuum electron device heater voltage performing the following: Monitoring the beam current in the vacuum electron device at a predetermined percent of the beam current that corresponds to a fully space charge limited operation of the vacuum electron device. And adjusting the heater voltage causing the beam current at the predetermined percent if and/or when the beam current differs from the predetermined percent.

BRIEF DESCRIPTION OF THE DRAWINGS

For a more complete understanding of the embodiments of the invention herein, reference may be had to the following detailed description in conjunction with the drawings wherein.

DETAILED DESCRIPTION

The embodiments of the present invention relate to an adaptive heater voltage algorithm and control system for setting and maintenance of vacuum electron device (VED) heater voltage. One such vacuum electron device is a klystron. An algorithm and control system are disclosed that set and maintain the VED's cathode at the lowest temperature required for 98% of the beam current that corresponds to fully space charge limited (FSCL) operation at a given cathode voltage. VED lifetime is dependent upon cathode temperature, and in general, a cooler cathode will last longer. One type of cathode is the well-known thermionic cathode which emits electrons upon being heated to a predetermined temperature, as opposed to a cold cathode. As a VED ages, the cathode must generally be operated at a higher temperature to assure FSCL operation. All klystron VEDs have a heated cathode that provides the electrons for the beam current that travels through the klystron's RF interaction circuit. The optimum heater voltage corresponds to the beam current that is 98% of the beam current during FSCL operation. As the klystron VED ages and the cathode becomes depleted, the heater voltage will need to be gradually increased to maintain the 98% FSCL value. There are, therefore, two stages to the adaptive heater voltage algorithm—(1) initial determination of the heater voltage and (2) the determination of the heater voltage during amplifier operation.

It is common practice to set the heater voltage of a VED, such as a klystron, so that the cathode temperature is 40 degrees centigrade (40° C.) above the start of fully space charge limited (FSCL) emission. The Miram Plot is a diagnostic tool used to determine the fully space charge limited emission point and can be seen in FIG. 1. The Miram Plot is generated by reducing the filament voltage and monitoring the beam current. In the case of a VED that may be operated at substantially different beam voltages, such as a klystron, the high voltage is adjusted to the operating voltage Vo and $(\frac{1}{2})^{2/3}Vo=0.63Vo$ for each heater setting to provide full beam current and half beam current when fully space charge limited, respectively. The full and half-current values are normalized to the maximum current for each set of data.

Figure 1:
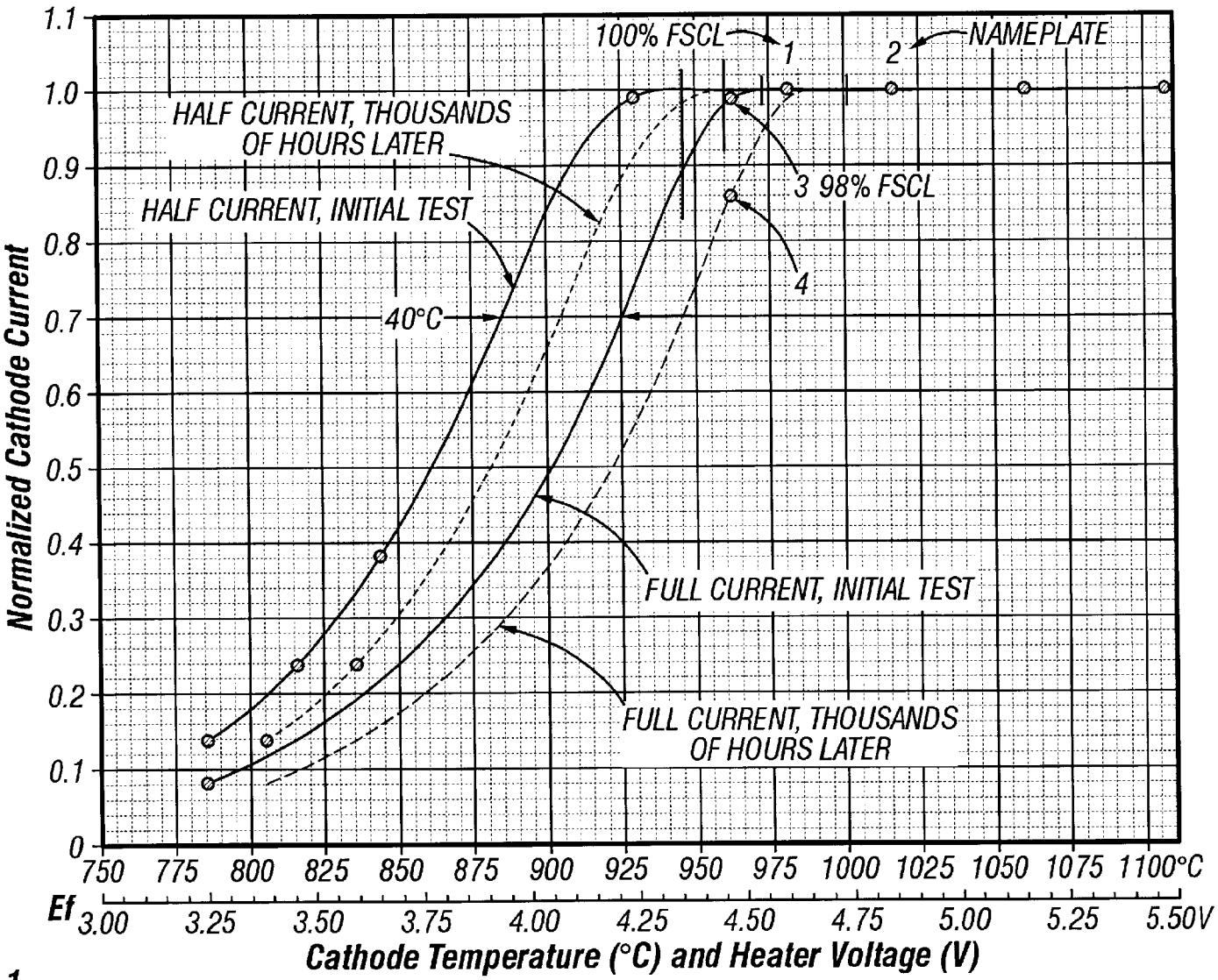
FIG. 1 is a Miram Curve for a cathode under pulse measurement condition.

To determine the fully space charge limited operating point, the normalized full and half current parts are superimposed and the point where the two curves intersect at 100% current is defined as Fully Space Charge Limited (FSCL) emission, as can be seen at point number 1 of FIG. 1. The M-type cathode is a well-known more efficient electron emitting type of cathode due to special coatings on the cathode surface. For a typical M-type dispenser cathode the difference in temperature at the 98% FSCL point between the full and half current curves is between 35° C. and 40° C. and can be seen also in FIG. 1. This information is used to set the heater to the proper point for fixed filament supply operation. The heater setting is increased by that amount above the fully space charge limited point, point number 2 of FIG. 1. This is done for several reasons. The first is to allow for variability in the manufacture of the cathode heater package. The second reason is to provide margin against temperature limited cathode operation. In a standard system, however, the heater voltage will not be adjusted during the life of the VED.

Substantially increased life expectancy can be achieved if the operating temperature is set to the 98% FSCL point, as shown in the Miram Plot of FIG. 1, point number 3. A good rule of thumb for an M-type dispenser cathode is that for every 40° C. reduction in temperature, the life expectancy of the cathode can be expected to double. It is noted that point number 3 of FIG. 1 is 60 degrees cooler than the nameplate operating point, number 2. The nameplate operating point are the values relating to each particular klystron's operating values as measured at the factory; including beam current, heater voltage, beam voltage, etc. The problem with operating the klystron VED at the 98% FSCL point under normal conditions is that within a period of time spanning the normal operating life of the VED, several thousand or tens of thousands of hours, the emission current will drop as the cathode ages. Cathode aging can be described as these data points slowly moving to the right, as seen by the dotted curves in FIG. 1. If the heater voltage was fixed initially at point 3, over time the beam current emission would be 85% of nameplate, as shown by the dotted curve and point number 4 of FIG. 1. Under normal circumstances the reduction of beam current below 85% would signify the end of life as defined by most manufacturers' specifications.

With computer control commonplace in power supplies used in klystron-based high power amplifiers (K-HPAs), the ability to monitor and actively control beam current, by varying the amount of filament supply power, can extend the life of the klystron by a factor of at least two. Some rules need to be developed to determine the initial filament settings along with how and when the filament power is increased. The Miram Plot is an integral part of the K-HPA programming and should be used for determining the initial 98% FSCL operating point as well as a diagnostic to be performed as necessary. A Miram Plot is established independently for each klystron tube. Care must be taken in obtaining this data due to the increased body current observed when operating the cathode temperature limited. Temperature limited indicates that as the heater voltage increases, the temperature of the cathode increases until the saturation point is reached on the Miram Plot, such that an increase in beam voltage, with a subsequent rise of cathode temperature, does not increase the klystron's beam current. The Miram Plot of FIG. 1 was taken under low duty factor pulse conditions, and as such the average body current at 75% FSCL and below is not sufficient to cause harm to the klystron. Under DC operation, as seen in amplifier operation, obtaining the Miram Plot at 75% FSCL and below can permanently damage the klystron. Thus, the cathode current should never be allowed to drop to less than 75% of the FSCL value when acquiring the data for the Miram Plot.

The starting point for the Miram Plot would be the nameplate filament voltage. That is, the initial value is the posted filament voltage of the klystron. The beam current is measured and stored for full and half beam current. The filament voltage is then decreased by one-tenth of a volt, the heater is allowed to stabilize by waiting five minutes, and the full and half beam current values are measured, stored, and normalized to the currents measured at the nameplate heater setting. This cycle continues until 85% FSCL is reached for operation at Vo. Generally, the 85% FSCL factor relates directly to an 85% value of the beam current in the VED. Further reduction by one-tenth of a volt should be done at that half current setting (V=0.63*Vo) until 85% FSCL is reached.

After performing the Miram diagnostic, the filament power should be adjusted for operation at the 98% FSCL current point.

During normal operation, the beam current should be continually monitored for slight reductions in current. Preferably, when the beam current drops below 97% FSCL, the filament should be adjusted to return the beam current to the 98% FSCL value. The initial Miram data can be used to determine the approximate filament voltage increase. Microperveance is a factor used to relate beam voltage to beam current. The relationship $Ky=I/V^{3/2}$ is used to determine if, for a given beam voltage, the proper beam current exists. If not, the heater voltage is incrementally increased until the 98% FSCL point is reached. Automatic corrections for slight overshoots of the FSCL percent may also be provided in this part of the adjustment.

Figure 2:
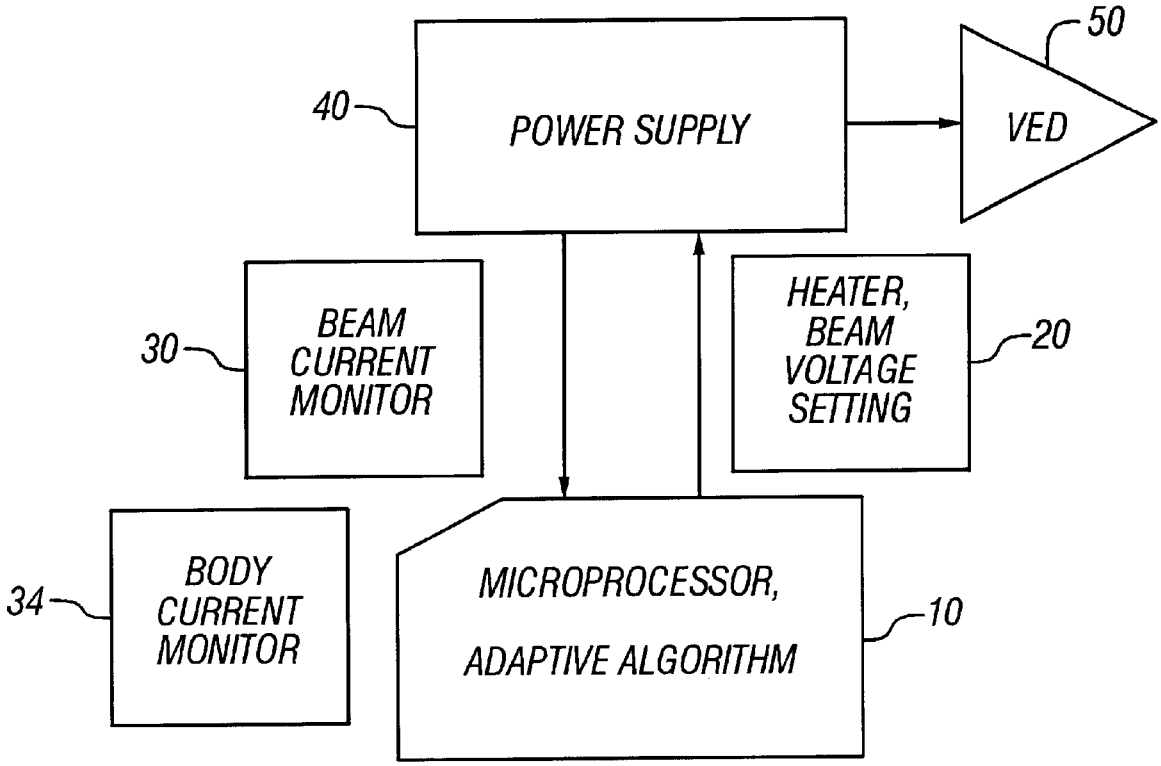
FIG. 2 is a block diagram of a system including the aspects of the embodiments of the present invention.

FIG. 2 shows a block diagram of a microprocessor system used to implement the algorithm and system set forth herein. The microprocessor 10 could be part of a personal computer or other general purpose or special purpose computer operating under control of an operating system utilizing a hard disk drive or other memory device from which the operating system is loaded into random access memory and on which application software and other data are stored. Such a personal computer system could have the well-known Windows® operating system under the control of a Pentium® microprocessor with accompanying memory. Other computers with different operating systems and microprocessors could work as well, however, as would be clear to those of ordinary skill in the art. In the klystron VED system disclosed herein, the program contents are stored in a flash RAM (random access memory) and runs on the amplifier's embedded control system. Those of ordinary skill in the art will now realize that many other arrangements for program storage may also be used.

A beam current monitor 30 monitors the beam current generated by power supply 40 and delivered to the klystron tube 50, a vacuum electron device, VED. Depending on the beam current as monitored, the adaptive algorithm stored in the computer in which microprocessor 10 is installed will signal the power supply 40 to increase or decrease the beam voltage setting as necessary. Increasing or decreasing the heater beam voltage 20 setting will increase the beam current to the VED filament as set forth herein.

Figure 3:
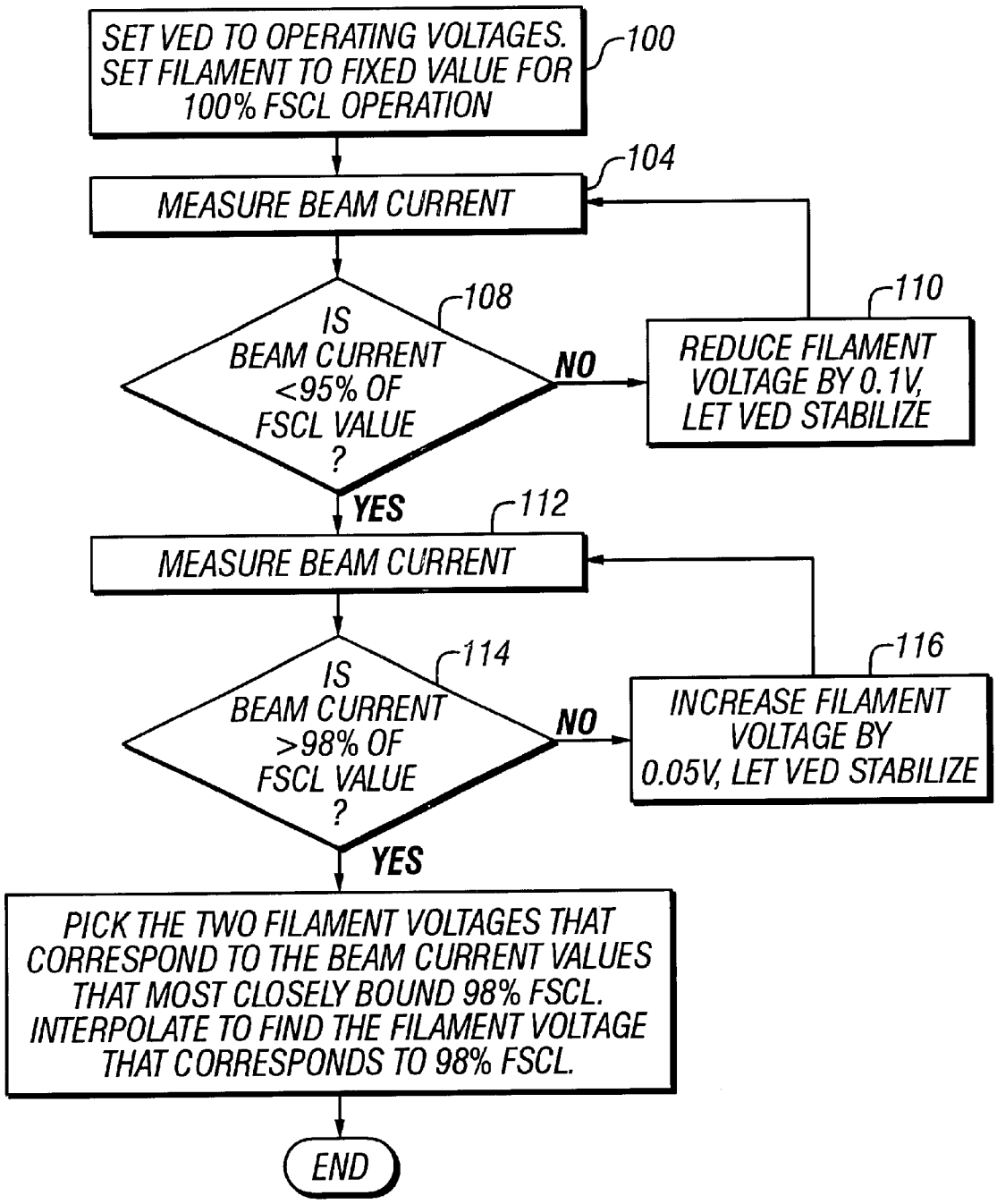
FIG. 3 is a flow chart indication of the steps taken to achieve the results of the embodiments herein.

FIG. 3 illustrates the steps to be taken to control the filament voltage of the VED. In step 100, the VED is set to the initial operating voltage for which the VED is designed. Then the filament voltage is preset to a fixed value to provide for a 100% FSCL at the VED 50. The beam current of the VED is then measured at step 114. If the VED beam current is measured to be greater than 95% of fully space charge limited operation at step 108, then the process proceeds to step 110. Here the filament voltage is reduced by 0.1V, step 110. After a finite amount of time, say five minutes, to allow the VED system to reach equilibrium, the beam current is measured again, step 114. If, at this point the beam current is still greater than 95% of FSCL, the filament voltage is decreased in 0.1V increments at step 110 until the VED beam current is at the 95% fully spaced charge limited operation.

Once this initial value setting of the filament voltage at 95% of FSCL is established, the filament voltage is measured during operation, step 112. If the beam current is measured at step 112 to be greater than 98% of FSCL value, then the two filament voltages that correspond to the beam current values that most closely bound 98% FSCL are interpolated to find the filament voltage that corresponds to 98% FSCL. If, however, the beam current as measured at step 114 is lower than 98% of FSCL value, the filament voltage is increased by 0.05V, step 116, and the beam current is measured again, step 112. If the FSCL is still less than 98%, step 114, the filament voltage is increased again at step 116. The time period is again waited, say five minutes for stabilization, and then the beam current is measured again. If the FSCL is still less than 98%, step 114, the filament voltage is increased at step 116. This process is continued by increasing the filament voltage by one-twentieth (0.05V) volt increments until the FSCL value is 98% of the value measured at step 112. Once the filament voltage is adjusted to cause the beam current to increase the FSCL value to 98%, the filament voltage is maintained at that value. If the FSCL value is measured at less than 98% FSCL at step 112, the filament voltage is increased at step 116 which will increase the beam current as measured at step 112. Thus, the system will continue to maintain the FSCL at the predetermined value of 98%.

Depending on the type of VED, suitable protection of the device is necessary if the beam current drops too low. This typically takes the form of a body current monitor, wherein the beam is shut off if the body current is too high.

With these adjustments, the definition of end of life of the klystron needs to be modified. The end of life would be defined as the same as existing products, namely, when the output power falls by approximately 80% of its rated value when the filament voltage is increased to its maximum rated value. This portion of the definition has been added for active heater management. Sometimes the reason for end of life may be excess arcing and/or body current during operation, which can also be seen near cathode end of life, and may occur before the simultaneous conditions above are met. The procedures set forth herein should be software controlled, with manual control not considered or attempted unless absolutely necessary.

Heater voltage management can thus greatly increase the life of thermionic cathodes, such as for klystrons and other devices. There are many types of thermionic emitters, for example, the 4CV100,000C Power Tetrode. This tube has a thoriated tungsten heater cathode. Reported performance and life expectancy is different from cathodes used in modern klystrons but the benefits to VED life are valid. Experience with the 4CV100,000C has shown that with heater voltage management, the life of the tube can be doubled.

While the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

What is claimed is:

1. A system for adaptively setting the heater voltage of a vacuum electron device comprising:

a control system responsive to an algorithm manifested in a computer program for maintaining the cathode of said vacuum electron device at the lowest temperature required for a predetermined percent of the beam current that corresponds to a fully space charge limited operation of said vacuum electron device.

2. The system as set forth in claim 1 wherein said control system comprises:

a microprocessor for executing the algorithm, a beam current monitor for monitoring the beam current in said vacuum electron device, a heater voltage source for generating a heater voltage for said vacuum electron device, said heater voltage source being adjusted to maintain said beam current in said vacuum electron device, and a power supply responsive to said heater voltage setting and said algorithm for supplying the vacuum electron device with said heater voltage.

3. The system as said forth in claim 2 wherein said vacuum electron device is a klystron.

4. A system for adaptively setting the heater voltage of a vacuum electron device comprising:

a control system responsive to an algorithm manifested in a computer program for maintaining the cathode of said vacuum electron device at the lowest temperature required for a predetermined percent of the beam current that corresponds to a fully space charge limited operation of said vacuum electron device, said predetermined percent of said beam current being about 98 percent, wherein said control system comprises:

a microprocessor for executing the algorithm;

a beam current monitor for monitoring the beam current in said vacuum electron device;

a heater voltage source for generating a heater voltage for said vacuum electron device, said heater voltage source being adjusted to maintain said beam current in said vacuum electron device; and a power supply responsive to said heater voltage setting and said algorithm for supplying the vacuum electron device with said heater voltage.

5. A system for adaptively setting the heater voltage of a vacuum electron device comprising:

a control system responsive to an algorithm manifested in a computer program for maintaining the cathode of said vacuum electron device at the lowest temperature required for a predetermined percent of the beam current that corresponds to a fully space charge limited operation of said vacuum electron device, said beam current initially set at a beam current equivalent to fully space charge limited vacuum electron device operation, wherein said control system comprises:

a microprocessor for executing the algorithm;

a beam current monitor for monitoring the beam current in said vacuum electron device;

a heater voltage source for generating a heater voltage for said vacuum electron device, said heater voltage source being adjusted to maintain said beam current in said vacuum electron device; and a power supply responsive to said heater voltage setting and said algorithm for supplying the vacuum electron device with said heater voltage.

6. The system as set forth in claim 5 wherein said beam current is then incrementally lowered until he fully space charge limited operation reaches a second predetermined percent thereof, said second predetermined percent being lower than said first mentioned predetermined percent.

7. The system as set forth in claim 6 wherein said beam current is then incrementally increased until the fully space charge limited operation reaches said first predetermined percent.

8. The system as set forth in claim 7 wherein said beam current is then maintained at a value sufficient to correspond to said first predetermined percent of fully space charge limited operation.

9. The system as said forth in claim 8 wherein said vacuum electron device is a klystron.

10. A system for adaptively setting the heater voltage of a vacuum electron device comprising:

a control system responsive to an algorithm manifested in a computer program for maintaining the cathode of said vacuum electron device at the lowest temperature required for a predetermined percent of the beam current that corresponds to a fully space charge limited operation of said vacuum electron device, said vacuum electron device is a klystron, said klystron disabled if and when the first predetermined percent of fully space charge limited operation falls to 80 percent, wherein said control system comprises:

a microprocessor for executing the algorithm;

a beam current monitor for monitoring the beam current in said vacuum electron device;

a heater voltage source for generating a heater voltage for said vacuum electron device, said heater voltage source being adjusted to maintain said beam current in said vacuum electron device; and a power supply responsive to said heater voltage setting and said algorithm for supplying the vacuum electron device with said heater voltage.

11. A program storage device readable by a machine, tangibly embodying a program of instructions executable by the machine to perform a method for setting and maintaining vacuum electron device (VED) heater voltage, the method comprising:

setting the heater voltage in said vacuum electron device to a value corresponding to the beam current for the fully space charge limited operation of said vacuum electron device, lowering the heater voltage generating said beam current in said vacuum electron device to a first predetermined percent of the beam current that corresponds to a fully space charge limited operation of said vacuum electron device, and then increasing the heater voltage generating said beam current at said first predetermined percent until said beam current corresponds to a second, higher, predetermined percent of the beam current that corresponds to a fully space charge limited operation of said vacuum electron device.

12. The device of claim 11 wherein said lowering the heater voltage generating the beam current includes measuring the beam current in said VED, monitoring the beam current in said VED, incrementally decreasing said heater voltage generating said beam current, and continuing lowering, measuring, and monitoring the beam current until the beam current is lowered to said first predetermined percent.

13. The device of claim 12 wherein said increasing the heater voltage generating the beam current includes measuring the beam current in said VED, monitoring the beam current in said VED, incrementally increasing said heater voltage generating said beam current, and continuing increasing, measuring, and monitoring the beam current until the beam current is raised to said second, higher predetermined percent of beam current.

14. The device of claim 13 further comprising:

maintaining the beam current at said second predetermined percent of the beam current corresponding to a fully space charge limited operation as said vacuum electron device ages and may require additional heater voltage to maintain the beam current at said second predetermined percent.

15. The device of claim 14 wherein said second predetermined percent of said fully space charge limited operation is 98 percent.

16. The device of claim 11 further comprising:

initially setting the heater voltage to a preset value to generate the beam current that corresponds to a fully space charge limited voltage operation of 100 percent;

incrementally lowering the initial setting of said heater voltage; and monitoring the beam current until said beam current corresponds to a fully space charge limited operation of 95 percent of the fully space charge limited operation of said vacuum electron device.

17. The device of claim 16 further comprising:

incrementally increasing the heater voltage;

monitoring the beam current until said beam current corresponds to a fully space charge limited operation of 98 percent of the fully space charge limited operation of said vacuum electron device.

18. A beam current monitoring system for a vacuum electron device comprising:

a power supply for generating the heater and beam voltage to said vacuum electron device, a beam current monitor for monitoring the beam current in said vacuum electron device and indicating to said power supply the heater voltage to generate said beam current in said vacuum electron device;

a microprocessor under software program management for controlling the heater voltage in response to the beam current monitor, wherein said software program includes an algorithm for maintaining the cathode of said vacuum electron device at the lowest temperature required for a predetermined percent of the beam current that corresponds to a fully space charge limited operation of said vacuum electron device.

19. The beam current monitoring system of claim 18 wherein said beam current monitor monitors the beam current in said vacuum electron device, and wherein said heater voltage source generates a heater voltage for application to said vacuum electron device, said heater voltage source being adjusted to maintain said beam current of said vacuum electron device, and further including a power supply responsive to said beam current monitor for supplying the vacuum electron device with said heater beam voltage.

20. The beam current monitoring system of claim 19 wherein said predetermined percent of said beam current is set to 98 percent.

21. The beam current monitoring system of claim 20 wherein said beam current is initially set at a beam current equivalent to a fully space charge limited vacuum electron device operation.

22. The beam current monitoring system of claim 21 wherein said heater voltage is then incrementally lowered until the fully space charge limited operation reaches a first predetermined percent thereof.

23. The beam current monitoring system of claim 22 wherein said heater voltage is then incrementally raised until the fully space charge limited operation reaches a second, higher, predetermined percent thereof, wherein the beam current is then maintained during operation at a value sufficient to correspond to said second predetermined percent of fully space charge limited operation.

24. The beam current monitoring system of claim 22 wherein said vacuum electron device is a klystron.

25. A beam current monitoring system for a vacuum electron device comprising program instructions for setting and maintaining said vacuum electron device heater voltage comprising:

means for monitoring the beam current in said vacuum electron device at a predetermined percent of the beam current that corresponds to a fully space charge limited operation of said vacuum electron device, and means for increasing the heater voltage to generate said predetermined percent beam current if and/or when said beam current falls below said predetermined percent, in response to an algorithm in the program instructions.

26. The beam current monitoring system of claim 25 further including:

means for decreasing said heater voltage to generate said predetermined percent beam current if and when said beam current is higher than said predetermined percent, in response to an algorithm in the program instructions.

27. A beam current monitoring system for a vacuum electron device comprising program instructions for setting and maintaining said vacuum electron device heater voltage comprising:

means for monitoring the beam current in said vacuum electron device at a predetermined percent of the beam current that corresponds to a fully space charge limited operation of said vacuum electron device;

means for increasing the heater voltage to generate said predetermined percent beam current if and/or when said beam current falls below said predetermined percent;

means for decreasing said heater voltage to generate said predetermined percent beam current if and/or when said beam current is higher than said predetermined percent;

means for initially setting the heater voltage to a preset value to generate the beam current that corresponds to a fully space charge limited voltage operation of 100 percent;

means for incrementally adjusting the initial setting of said heater voltage to generate said beam current that corresponds to an actual fully space charge limited voltage operation of 95 percent; and means for increasing the filament voltage to said vacuum electron device to raise the beam current corresponding to 98 percent of the fully space charge limited operation of said vacuum electron device.

28. The beam current monitoring system of claim 27 further comprising:

means for maintaining the beam current at said predetermined percent of the beam current corresponding to a fully space charge limited operation as said vacuum electron device ages and may require a higher filament voltage to maintain the beam current at said predetermined percent.

29. The beam current monitoring system of claim 28 wherein said predetermined percent of said fully space charge limited operation is 98 percent.

30. A method for setting and maintaining vacuum electron device (VED) heater voltage, the method comprising:

setting the heater voltage in said vacuum electron device to a value corresponding to the beam current for the fully space charge limited operation of said vacuum electron device, lowering the heater voltage generating said beam current in said vacuum electron device to a first predetermined percent of the beam current that corresponds to a fully space charge limited operation of said vacuum electron device, and then increasing the heater voltage generating said beam current at said first predetermined percent until said beam current corresponds to a second, higher, predetermined percent of the beam current that corresponds to a fully space charge limited operation of said vacuum electron device.

31. The method of claim 30 wherein said lowering the heater voltage generating the beam current includes measuring the beam current in said VED, monitoring the beam current in said VED, incrementally decreasing said heater voltage generating said beam current, and continuing lowering, measuring, and monitoring the beam current until the beam current is lowered to said first predetermined percent.

32. The method of claim 31 wherein said increasing the heater voltage generating the beam current includes measuring the beam current in said VED, monitoring the beam current in said VED, incrementally increasing said heater voltage generating said beam current, and continuing increasing, measuring, and monitoring the beam current until the beam current is raised to said second, higher predetermined percent of beam current.

33. The method of claim 32 further comprising:

maintaining the beam current at said second predetermined percent of the beam current corresponding to a fully space charge limited operation as said vacuum electron device ages and may require additional heater voltage to maintain the beam current at said second predetermined percent.

34. The method of claim 33 wherein said second predetermined percent of said fully space charge limited operation is 98 percent.

35. The method of claim 30 further comprising:

initially setting the heater voltage to a preset value to generate the beam current that corresponds to a fully space charge limited voltage operation of 100 percent;

incrementally lowering the initial setting of said heater voltage; and monitoring the beam current until said beam current corresponds to a fully space charge limited operation of 95 percent of the fully space charge limited operation of said vacuum electron device.

36. The method of claim 35 further comprising:

incrementally increasing the heater voltage;

monitoring the beam current until said beam current corresponds to a fully space charge limited operation of 98 percent of the fully space charge limited operation of said vacuum electron device.

37. A system for adaptively setting the heater voltage applied to a heater for a vacuum electron device (VED) powered by a power supply, said system comprising:

a beam monitor responsive to current provided to the VED by the power supply;

a memory containing a set of data reflecting an algorithm for maintaining the cathode of said VED at the lowest temperature required for a selected percent of the beam current that corresponds to a fully space charge limited operation of said VED; and a voltage controller for adjusting the heater voltage applied by the power supply to the heater of the VED, said heater voltage controller being responsive to said beam monitor and said memory to maintain VED operation at a selected percent of full space charge operation.

* * * * *

UNITED STATES PATENT AND TRADEMARK OFFICE

CERTIFICATE OF CORRECTION

PATENT NO. : 6,456,009 B1 
DATED : September 24, 2002
INVENTOR(S) : Edward L. Wright and Eric Oiesen It is certified that error appears in the above-identified patent and that said Letters Patent is hereby corrected as shown below:

Column 6,
Line 63, replace "he" with -- the --.

Signed and Sealed this

First Day of July, 2003

JAMES E. ROGAN
*Director of the United States Patent and Trademark Office*